US010142753B2

(12) United States Patent
Petroff et al.

(10) Patent No.: US 10,142,753 B2
(45) Date of Patent: Nov. 27, 2018

(54) ELECTROACOUSTIC CONVERSION CHAIN WITH SELECTIVELY POWERED COIL

(71) Applicant: DEVIALET, Paris (FR)

(72) Inventors: Antoine Petroff, Bournens (CH); Pierre-Emmanuel Calmel, Le Chesnay (FR); Jean-Loup Nat Afresne, Bournens (CH)

(73) Assignee: Devialet, Paris (FR)

( * ) Notice: Subject to any disclaimer, the term of this patent is extended or adjusted under 35 U.S.C. 154(b) by 0 days.

(21) Appl. No.: 14/897,263

(22) PCT Filed: Jun. 2, 2014

(86) PCT No.: PCT/EP2014/061396
§ 371 (c)(1),
(2) Date: Dec. 10, 2015

(87) PCT Pub. No.: WO2014/198578
PCT Pub. Date: Dec. 18, 2014

(65) Prior Publication Data

US 2016/0142841 A1 May 19, 2016

(30) Foreign Application Priority Data

Jun. 10, 2013 (FR) ..... 13 55337

(51) Int. Cl.
*H04R 29/00* (2006.01)
*G10L 19/083* (2013.01)
(Continued)

(52) U.S. Cl.
CPC ..... *H04R 29/003* (2013.01); *G10L 19/083* (2013.01); *H04R 3/007* (2013.01);
(Continued)

(58) Field of Classification Search
CPC ..... H04R 9/046
See application file for complete search history.

(56) References Cited

U.S. PATENT DOCUMENTS 6,130,954 A * 10/2000 Carver ..... H03F 1/0227 381/398
2009/0028371 A1 1/2009 Bailey
(Continued)

FOREIGN PATENT DOCUMENTS

GB 2384938 A 8/2003

OTHER PUBLICATIONS

International Search Report dated Sep. 8, 2014 issued in corresponding PCT Application No. PCT/EP2014/061396.

*Primary Examiner* — Duc Nguyen
*Assistant Examiner* — Phan Le
(74) *Attorney, Agent, or Firm* — Troutman Sanders LLP

(57) ABSTRACT

This electroacoustic conversion chain comprising at least one loudspeaker, this loudspeaker comprising means for generating a magnetic field in a magnetic circuit having an air gap and a membrane secured to turns of a conducting material which may move in this air gap, is characterized in that it comprises at least one control module comprising at least one input for conveying a signal to be broadcast and at least one output connected to a turn, the control module being able to apply to said or each output an excitation signal depending on the position of at least one turn relatively to the air gap.

10 Claims, 4 Drawing Sheets

(51) Int. Cl.
*H04R 3/00* (2006.01)
*H04R 9/02* (2006.01)
*H04R 9/04* (2006.01)

(52) U.S. Cl.
CPC ..... *H04R 9/025* (2013.01); *H04R 9/046* (2013.01); *H04R 2209/021* (2013.01); *H04R 2209/041* (2013.01)

(56) References Cited

U.S. PATENT DOCUMENTS

| | | | | |
|---|---|---|---|---|
| 2009/0028374 | A1* | 1/2009 | Hashimoto | H04R 3/002 381/401 |
| 2012/0177247 | A1* | 7/2012 | Li | H04R 9/025 381/412 |
| 2012/0257782 | A1* | 10/2012 | French | H04R 3/00 381/400 |
| 2012/0269378 | A1 | 10/2012 | Stead | |

* cited by examiner

ELECTROACOUSTIC CONVERSION CHAIN WITH SELECTIVELY POWERED COIL

CROSS-REFERENCE TO RELATED APPLICATIONS

This application is the U.S. National Phase of International Patent Application Serial No. PCT/EP2014/061396, filed Jun. 2, 2014, which claims priority to French Patent Application No. 1355337, filed Jun. 10, 2013, both of which are herein incorporated by reference in their entireties.

FIELD OF THE INVENTION

The present invention relates to an electroacoustic conversion chain, of the type comprising at least one loudspeaker, this loudspeaker comprising means for generating a magnetic field in a magnetic circuit having an air gap and a membrane secured to turns of a conducting material which may move in this air gap.

BACKGROUND OF THE INVENTION

Such an electroacoustic conversion chain gives the possibility of converting an electric signal to be broadcast into an acoustic signal.

Conventionally, the electroacoustic conversion chain comprises a loudspeaker. The latter comprises an axially biased toroidal magnet inserted in a magnetic field. This magnetic circuit delimits a ring-shaped air gap where a magnetic field prevails.

The loudspeaker also comprises a conducting material coil wound and secured around a tube extended with a membrane capable of generating an acoustic wave.

The coil is intended to receive a current depending on the signal to be broadcast and partly extends in the air gap in which it is axially mobile.

The coil has an axial length such that, during the operation of the loudspeaker, all or part of the coil is found in the air gap.

During the operation of the electroacoustic conversion chain, the whole of the magnet is powered. The turns of the coil present in the air gap are subject to Laplace forces which will cause them to move along the axis of the tube. The displacement of these turns causes displacement of the membrane via the tube, causing generation of sound.

This embodiment has an electroacoustic yield because of the losses by the Joule effect in the coil.

SUMMARY OF THE INVENTION

The object of the invention is therefore to propose an electroacoustic conversion chain having a better yield.

For this purpose, the object of the invention is an electroacoustic conversion chain of the aforementioned type, characterizing that it comprises at least one control module comprising at least one input for conveying a signal to be broadcast and at least one output connected to a turn, the control module being able to apply to said or each terminal an excitation signal depending on the position of at least one turn relatively to the air gap.

By varying the value of the current crossing a turn according to the position relatively to the air gap, so that this current is reduced or zero when said turn is found outside the air gap, the yield of the electroacoustic conversion chain is improved by reducing or canceling out the losses by the Joule effect of the turns which are unable to contribute to the movement of the membrane since they are outside the air gap.

According to particular embodiments, the invention has one or several of the following features:

- the control module is able to apply a zero signal to all or part of the turns outside the air gap;
- the control module comprises at least one input for conveying a position signal relatively to the air gap of at least one turn;
- the chain comprises turns successively positioned along their axis and electrically connected so as to form at least two disconnected coils positioned in succession;
- each output of the control module is connected to a single coil;
- the chain comprises means for measuring on the loudspeaker the position relatively to the air gap of at least one turn;
- the control module is able to apply on each turn an excitation signal all the weaker when this turn is away from the air gap;
- the control module is able to control the potential at at least one of its outputs;
- the control module is able to apply to at least one of its outputs a potential such that the voltage on the terminals of the corresponding coil is zero;
- the magnetic circuit comprises at least two disconnected magnets, the magnets delimiting between them grommet spaces in which pass wires for powering the coils; and
- the magnetic circuit comprises a central core comprising longitudinal ribs each partly receiving a wire for powering the coils.

BRIEF DESCRIPTION OF THE DRAWINGS

The invention will be better understood by means of the description which follows, only given as an example and made with reference to the appended drawings wherein.

DETAILED DESCRIPTION OF THE DRAWINGS

Figure 1:
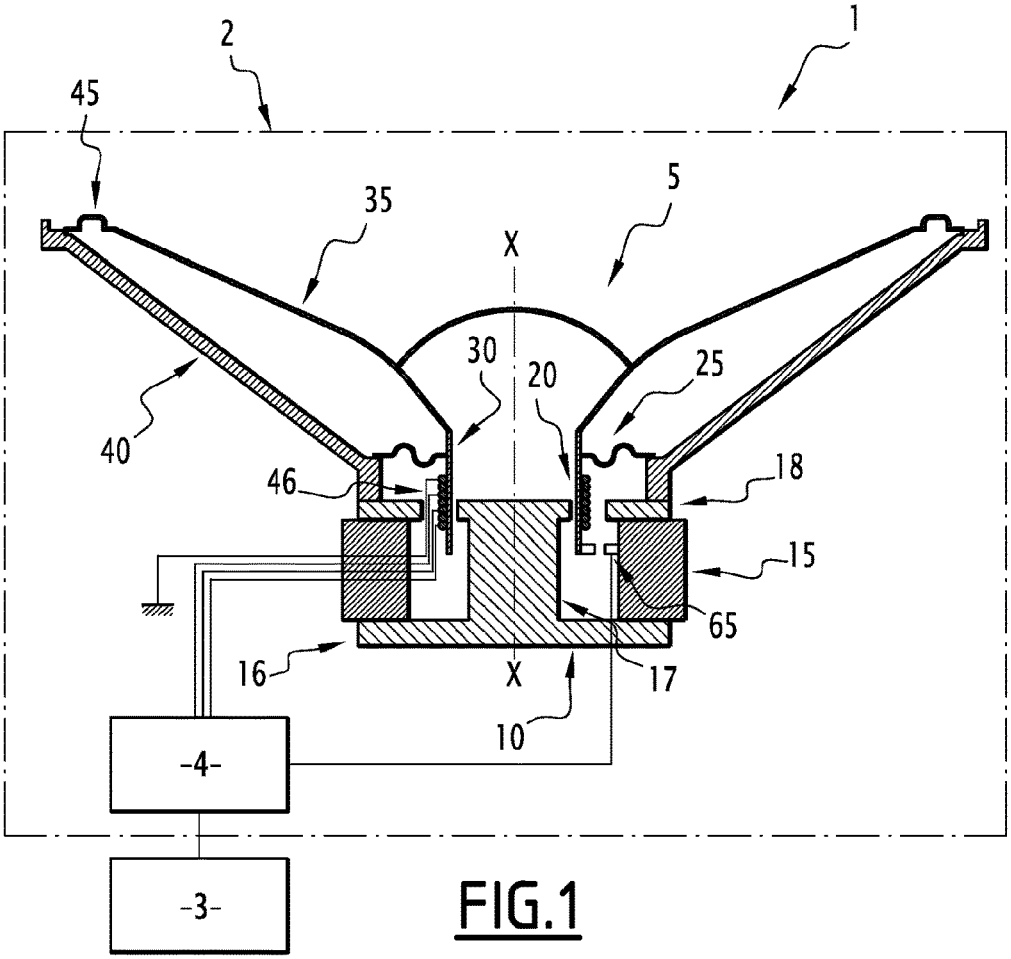
FIG. 1 is a diagram of an exemplary embodiment of a sound reproduction device comprising an electroacoustic conversion chain according to the invention, one loudspeaker of which is illustrated in a sectional view.

The sound reproduction device 1 illustrated in FIG. 1 comprises the electroacoustic conversion chain 2, the input of which is connected to the output of a source 3 of a signal to be broadcast.

The electroacoustic conversion chain 2 comprises a control module 4 capable of processing the signal to be broadcast and a loudspeaker 5. The control module 4 is connected to the loudspeaker for its excitation.

The loudspeaker 5 comprises a magnetic circuit 10 in which a toroidal magnet 15 is positioned.

The magnetic circuit 10 comprises a yoke 16, comprising a central core 17, and an upper plate 18.

The magnet is clasped between the yoke 16 and the upper plate 18.

The air volume between the central core 17 and the upper plate 18 defines an air gap 20, generally toroidal, positioned along an axis X-X of the loudspeaker.

A mobile assembly 25 comprising a guiding tube 30 extended with a membrane 35 is slidably mounted along the axis X-X of the loudspeaker relatively to the magnetic circuit.

The membrane 35 is maintained on its external edge to a chassis 40 of the loudspeaker by means of a peripheral suspension 45.

The mobile assembly 25 also comprises a set of turns 46 of a conducting material, wound around the tube 30 to which they are secured. The turns are intended to be covered by a current depending on the signal to be broadcast, this current stemming from the control module 4.

Figure 2:
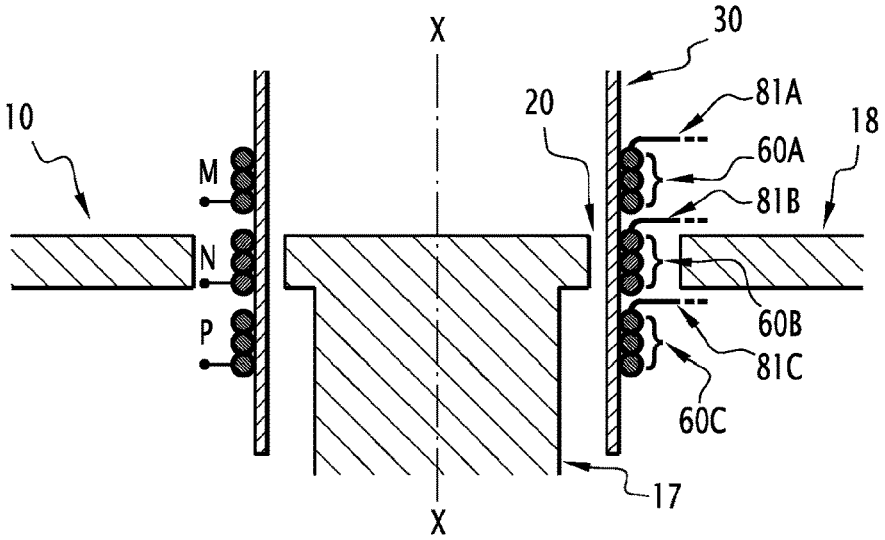
FIG. 2 is a detail of a sectional view of an embodiment of a loudspeaker according to the invention.

As this appears in FIG. 2, the turns are electrically connected to each other in order to form coils 60A, 60B, 60C, these coils being electrically independent. Each coil 60A, 60B and 60C is electrically connected through one of its ends to a point M, N, P respectively. The points M, N, P for example have different set electric potentials.

The coils are successively positioned along the length of the mobile assembly extending along the axis X-X. Each coil has an axial length substantially equal to the height of the air gap.

Figure 3:
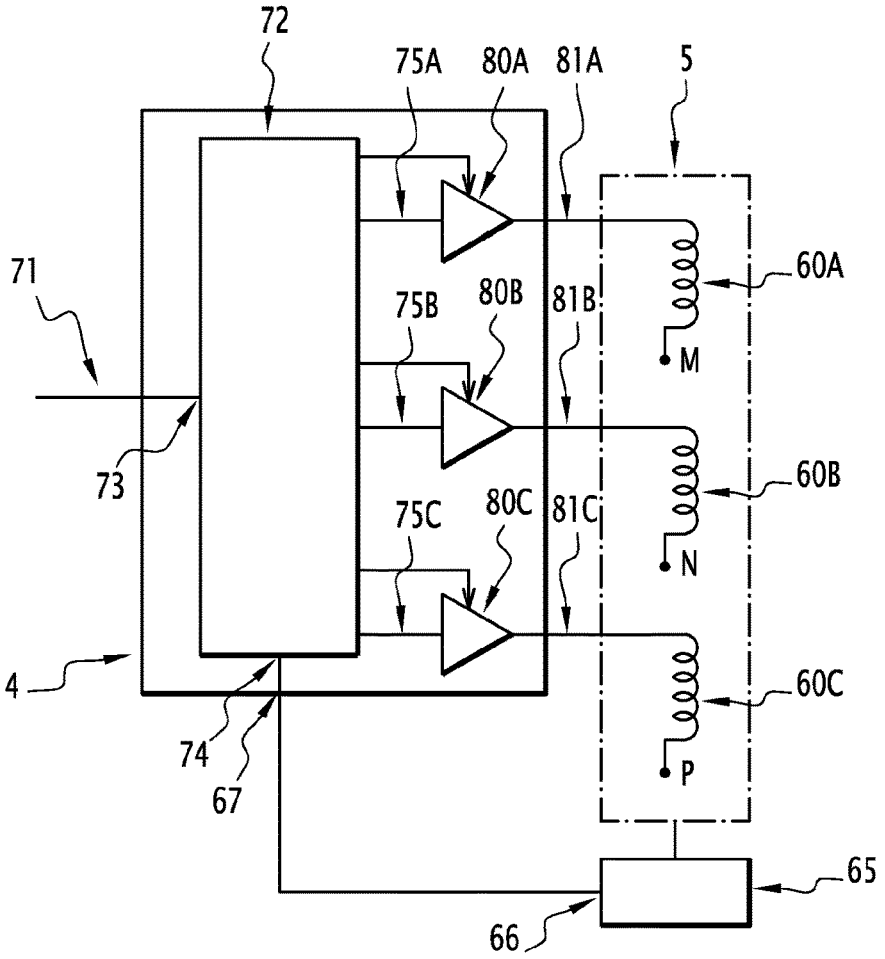
FIG. 3 is a block diagram illustrating the general structure of an embodiment of an electroacoustic conversion chain according to the invention.

In an embodiment of an electroacoustic conversion chain according to the invention, the chain comprises means 65 on the loudspeaker for measuring the axial position relatively to the air gap of at least one turn, visible in FIGS. 1 and 3.

These measurement means 65 have an output 66, connected to an input 67 of the control module 4, illustrated in FIG. 3.

An input 71 of this control module is intended to receive the signal to be broadcast.

The control module 4 comprises a routing unit 72 for determining a power supply signal specific to each coil 60A, 60B, 60C.

The routing unit comprises an input 73 connected to the input 71 of the control module 4, and an input 74 connected to the input 67 of this same control module.

The routing unit 72 also comprises three outputs 75A, 75B and 75C.

Each of these outputs 75A, 75B and 75C is followed by an amplifier, 80A, 80B and 80C, respectively.

The output of each of these amplifiers 80A, 80B and 80C is respectively connected to one of the three outputs 81A, 81B and 81C of the control module 4.

The routing unit 72 is capable of determining, according to the displacement of the turns through the air gap, the value of the electric current at each of the outputs of the control module 4 so that the coils at least partly present in the air gap are powered.

For this purpose, the routing unit 72 is able to control the gain K of the amplifier associated with the excitation signal from each of the outputs 81A, 81B and 81C of the control module 4.

For each of these outputs 81A, 81B and 81C of the control module 4, this gain K is maximum when the coil connected to this output, respectively 60A, 60B, 60C, is found centered in the air gap along X-X.

This gain K is all the smaller since the relevant coil is away from this centered position.

Figure 4:
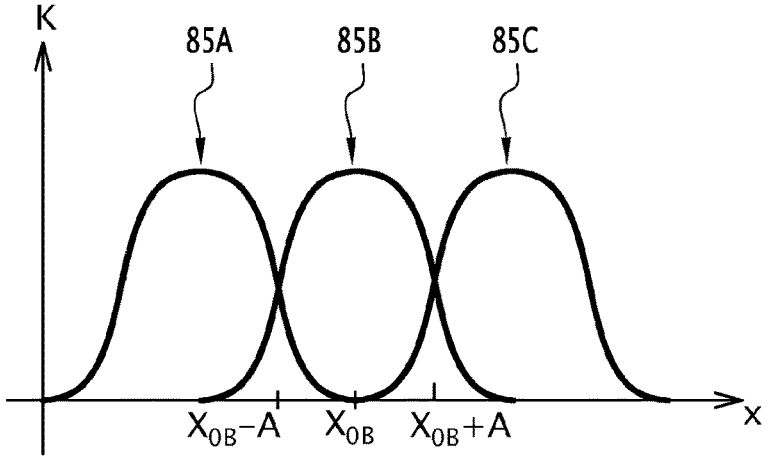
FIG. 4 is a set of curves illustrating the gains of the amplifiers connected to three groups of turns during their displacement through the air gap in an embodiment of a loudspeaker according to the invention.

In FIG. 4, the curves 85A, 85B and 85C respectively represent the time-dependent change of the gain K for each of the coils 60A, 60B and 60C during their travel through the 'air gap.

"x" refers to the distance along the X-X axis between the yoke 16 and the end of the tube 30 the closest to this yoke.

For each of the outputs 81A, 81B and 81C of the control module 4, the gain K for example follows the law:

$$K = P * \exp\left[-\frac{\ln(2) * (x - x_o)^2}{A^2}\right],$$

wherein P, $A^2$ and $x_0$ are three real numbers.

$x_0$ is a real number specific to each coil. In this case, this is the distance x for which the gain K for the relevant coil is maximum.

P is a constant determining the maximum gain which each of the amplifiers 80A, 80B and 80C is able to apply between its input and its output.

$A^2$ is the square of half the distance between two successive coils.

For example, the gain of the amplifier 80B, illustrated by curve 85B, is maximum when the coil 60B, to which this amplifier is connected, is centered in the air gap at the position $x_{0\bar{B}}$. Gradually as the tube moves away from the yoke, and that the coil 60B moves out of the air gap while the coil 60C advances therein, the gain of the amplifier 80B decreases while the gain of the amplifier 80C increases, as this appears on curve 85C.

Figure 5:
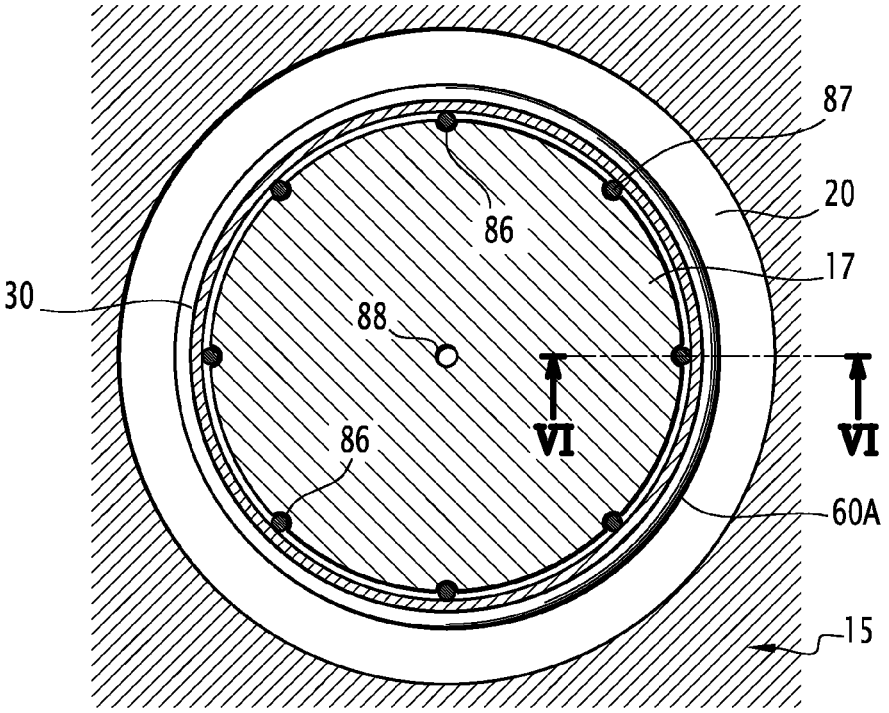
FIG. 5 is a detail of a sectional view along a plane orthogonal to the axis X-X of another embodiment of a loudspeaker according to the invention.
Figure 6:
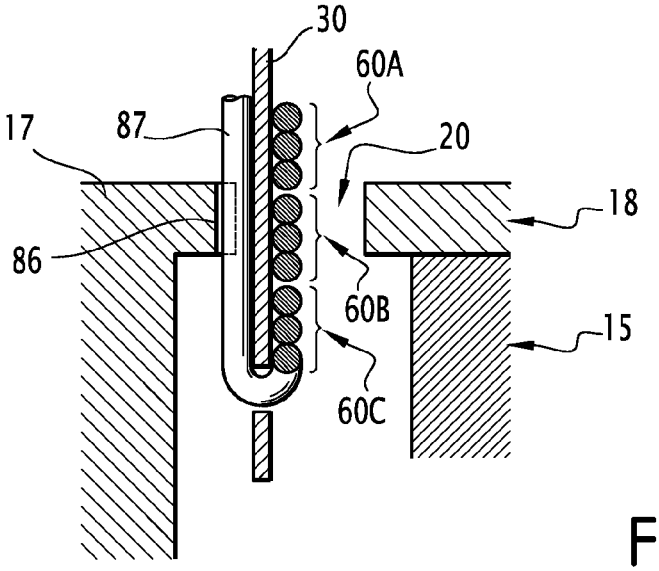
FIG. 6 is a detail of a sectional view along the plane VI-VI of the loudspeaker of FIG. 5.

According to another embodiment of the loudspeaker, partly illustrated in FIGS. 5 and 6, the central core 17 comprises longitudinal grooves 86 partly receiving each power supply wire 87 of the coils 60A, 60B, 60C.

The power supply wires 87 are positioned inside the guiding tube 30, as this appears in FIG. 6, and crossing the guiding tube 30 in order to power the coils 60A, 60B, 60C.

A channel 88 crossing the central core 17 and the yoke 16 gives the possibility of conveying the power supply wires 87 towards the control module 4.

Figure 7:
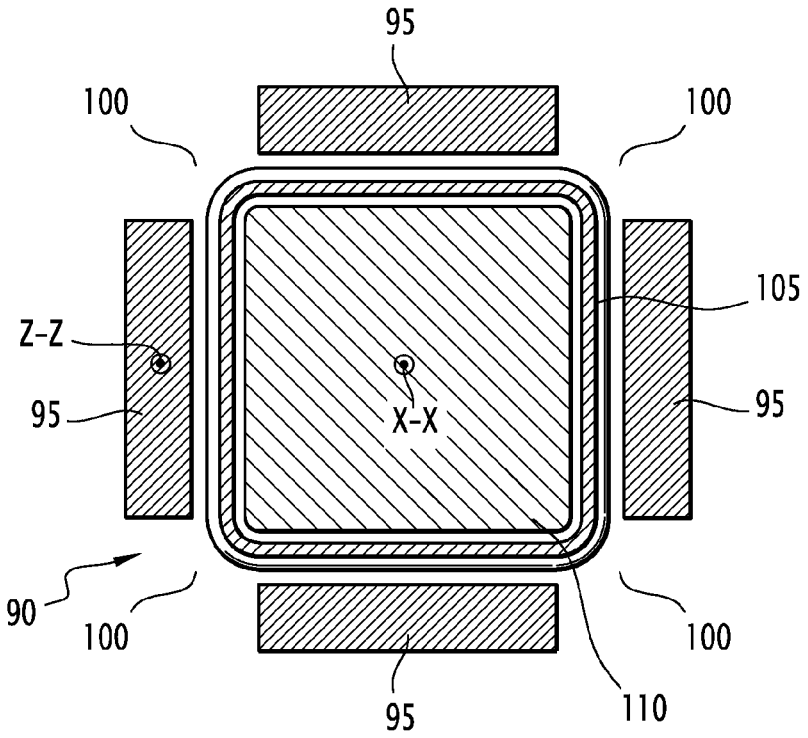
FIG. 7 is a detail of a top view of the magnetic circuit of another embodiment of a loudspeaker according to the invention.

According to another embodiment of the loudspeaker according to the invention, partly illustrated by FIG. 7, a magnetic circuit 90 of the loudspeaker 5 comprises at least two magnets, for example four disconnected magnets 95. A magnetic axis Z-Z of each magnet 95 is substantially parallel to the axis X-X of the loudspeaker 5.

The magnets 95 are positioned in the magnetic circuit 90 by defining between them grommet spaces 100.

The grommet spaces 100 are capable of allowing the passing of electric wires, for example the electric wires for powering coils 105 of the loudspeaker 5.

The coils 105 advantageously have a polygonal section in a plane orthogonal to the X-X axis, for example a square section.

A central core 110 of the magnetic circuit 90 advantageously has the same polygonal section as the coils 105.

According to another embodiment not shown of a conversion chain according to the invention, the routing unit 72 is capable of imposing an electric potential specific to the output 81A, 81B, 81C of the corresponding amplifier 80A,

80B, 80C respectively, when the coil which is connected thereto, 60A, 60B, 60C respectively, is not powered.

The electric potential imposed to each output 81A, 81B, 81C is such that the electric voltage between the output 81A, 81B, 81C, and the point M, N, P respectively, is substantially opposed to the induced electric voltage at the terminals of the corresponding coil, 60A, 60B, 60C respectively, by the displacement of this coil in the magnetic field generated by the magnet(s) of the loudspeaker.

Indeed, the electric voltage induced by the displacement of the coils in the magnetic field prevailing in the loudspeaker generates an induced electric current. This induced electric current generates a counter electromotive force opposing the displacement of the mobile assembly, which reduces the electroacoustic yield of the electroacoustic conversion chain.

By canceling out the electric voltage induced by a substantially opposed electric voltage imposed by the routing unit 72, the counter electromotive force is cancelled out and the electroacoustic yield of the electroacoustic conversion chain is increased.

The invention claimed is:

1. An electroacoustic conversion chain comprising at least one loudspeaker, this loudspeaker comprising at least one magnet for generating a magnetic field in a magnetic circuit having an air gap and a membrane secured to turns of conducting material which may be moved in this air gap;

at least one control module comprising at least one input conveying a signal to be broadcast and at least one output connected to at least a turn, the control module being able to:

apply to the at least one output an excitation signal based on the position of at least one turn relative to the air gap of the at least one turn connected to the output; and apply on each turn, a weaker amplitude of the excitation signal when this turn is moved away from the air gap, wherein the chain comprises turns positioned in succession and electrically connected so as to form at least two coils positioned successively, and wherein each output of the control module being connected to a single coil.

2. The chain according to claim 1, wherein the control module is able to apply a zero signal to all or part of any turns outside the air gap.

3. The chain according to claim 1, wherein the control module comprises at least one input for conveying a position signal of at least one turn relative to the air gap.

4. The chain according to claim 1, the chain comprising turns positioned in succession along a shared axis and electrically connected so as to form at least two disconnected coils positioned in succession.

5. The chain according to claim 4, wherein each output of the control module is connected to a single coil.

6. The chain according to claim 1, wherein the chain comprises modules on the loudspeaker for measuring the position relatively to the air gap of at least one turn.

7. The chain according to claim 1, wherein the control module is able to control the potential of at least one of its outputs.

8. The chain according to claim 7, wherein the control module is able to apply to at least one of its outputs a potential such that the voltage at the terminals of the corresponding coil is zero.

9. The chain according to claim 1, wherein the magnetic circuit comprises at least two disconnected magnets, the magnets delimiting between them grommet spaces in which pass power supply wires for the coils.

10. The chain according to claim 1, wherein the magnetic circuit comprises a central core comprising longitudinal grooves, each groove partly receiving a power supply wire of a coil.

* * * * *